US007363791B2

(12) United States Patent
Bodnar

(10) Patent No.: US 7,363,791 B2
(45) Date of Patent: Apr. 29, 2008

(54) ROTARY STAMPING APPARATUS AND METHOD OF FORMING SHEET METAL

(75) Inventor: Ernest R Bodnar, Burlington (CA)

(73) Assignee: GCG Holdings Ltd, Nassau (BS)

( * ) Notice: Subject to any disclaimer, the term of this patent is extended or adjusted under 35 U.S.C. 154(b) by 0 days.

(21) Appl. No.: 11/510,823

(22) Filed: Aug. 28, 2006

(65) Prior Publication Data

US 2007/0044532 A1 Mar. 1, 2007

Related U.S. Application Data

(60) Provisional application No. 60/711,679, filed on Aug. 29, 2005.

(51) Int. Cl.
*B21B 21/00* (2006.01)

(52) U.S. Cl. ..... 72/192; 72/190; 72/207; 72/249; 72/379.6

(58) Field of Classification Search ..... 72/184, 72/190, 192, 207, 249, 385, 379.6
See application file for complete search history.

(56) References Cited

U.S. PATENT DOCUMENTS

| | | | | | |
|---|---|---|---|---|---|
| 873,997 | A * | 12/1907 | Ebinghaus et al. | ..... | 72/192 |
| 3,911,710 | A * | 10/1975 | Gest | ..... | 72/193 |
| 3,955,391 | A * | 5/1976 | Wilson | ..... | 72/190 |
| 4,059,000 | A * | 11/1977 | Bodnar | ..... | 72/197 |
| 5,168,744 | A * | 12/1992 | Heitze | ..... | 72/446 |
| 5,561,998 | A * | 10/1996 | Bodnar | ..... | 72/190 |
| 2004/0221635 | A1 * | 11/2004 | Bauder | ..... | 72/192 |

* cited by examiner

*Primary Examiner*—Dmitry Suhol

(57) ABSTRACT

A rotary stamping apparatus for forming moving sheet metal and having a die assembly moveable forward and backward along a linear path, with upper and lower dies on respective sides of the sheet metal, the dies being closeable on the sheet metal for forming, and, a rotary drive crank system coupled to the die assembly, and operable to move the die assembly forward and backward along the linear pat, and being further operable to close the dies the sheet metal. Also disclosed is a method of forming moving sheet metal by such apparatus.

11 Claims, 4 Drawing Sheets

ROTARY STAMPING APPARATUS AND METHOD OF FORMING SHEET METAL

This application claims priority of U.S. Provisional Application Ser. No. 60/711,679, filed Aug. 29, 2005, Inventor E R Bodnar, Title ECCENTRIC ROTARY STAMPING APPARATUS & METHOD OF FORMING SHEET METAL.

The invention relates to rotary stamping apparatus employing flying dies, for forming sheet metal moving along a forming path, and to a method of forming sheet metal.

BACKGROUND OF THE INVENTION

Apparatus for stamping and forming sheet metal moving along a movement path in the past, has employed flying dies, moving along rails, on either side of the sheet metal. Other forms of moving die apparatus have employed dies mounted on a rotary core, with the dies moving around a more or less circular path.

The rotary moving die apparatus is of complex design, and requires great precision in the control of movement. Flying dies moving to and fro on rails, are easier to design and build and control, because the movement of the die is linear instead of rotary. The rotary type of moving die apparatus seems to offer some advantages in that the rotation of the rotors carrying the dies is continuous in one direction. By contrast the movement of flying dies moving on rails is necessarily a reciprocation, from forward to stop to reverse to stop to forward and so on. One of the problems in the design of flying dies moving on rails, is that the dies, and their associated die plates and movement mechanism represents a fairly heavy mass of metal, and that entire mass must be accelerated from zero, to the line speed of the sheet metal and then stopped, reversed and reaccelerated again. In one highly successful form of flying shear, designed by the present inventor, the acceleration was achieved by a pneumatic cylinder and the reverse movement was achieved by a gear and a rack system.

It has now been found that in the flying die system, the forward and reverse movement can advantageously achieved through a continuously rotating crank. This form of movement reduces the mass of metal parts which must be starting and stopping, since the movement is achieved through a continuously rotating crank. With this improvement, the flying dies can be operated at a much higher line speed, enabling the running of the complete sheet metal production line at a greater efficiency.

BRIEF SUMMARY OF THE INVENTION

The invention provides a rotary stamping apparatus for forming moving sheet metal with dies which are driven to and fro by a rotary crank, thereby achieving a much higher line speed than was possible with earlier apparatus.

The invention provides a stamping apparatus in which one of the forming dies are moveable in a linear direction along rails, parallel to the sheet metal moving on the production line, and in which the other die moves on an arcuate path, and in which the drive and power mechanism for the dies comprises a form of a rotary crank device.

A speed adjustment mechanism is incorporated for correcting slight mismatching between the line speed of the metal and the speed of the dies.

Preferably there are upper and lower dies forming a die assembly, the terms upper and lower simply indicating dies on opposite sides of the sheet metal. The upper die is moved by a rotary drive along a generally arcuate path, and the lower die is moved by a drive along a linear path, the drives being connected to ensure movement of the dies in unison and in registration with one another.

The drive transmission for the upper die is an eccentric rotary drive and the drive transmission for the lower die is a rotary crank in the form of a cam follower which drives the lower die to and fro along its linear path the two drives being connected and driven by a common prime mover.

The invention also provides a method of forming sheet metal, using such apparatus.

For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
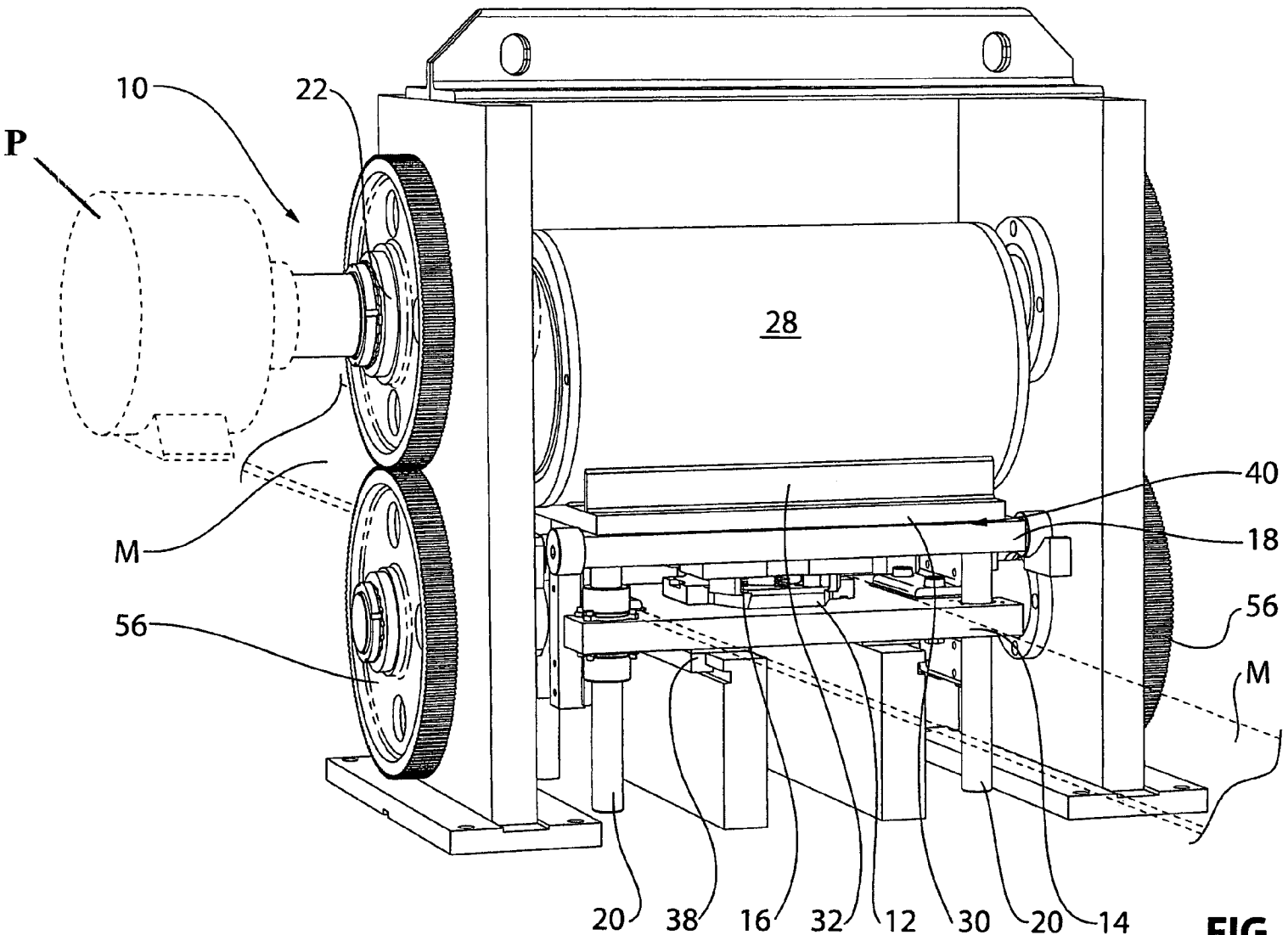
FIG. 1 is a general perspective illustration of a form of apparatus.

The drawings illustrate a rotary stamping apparatus (10). A lower die (12) is mounted on lower die bed (14). An upper die (16) is mounted on upper die bed (18). The upper and lower die beds are connected by die posts (20). The upper and lower dies and die beds thus form a single moveable die assembly, which moves forward and back as one along the path of the sheet metal (below).

The sheet metal on the production line is indicated in phantom as (M).

The drive mechanism is illustrated generally as the shaft (22) driven by a suitable prime mover (P). The upper die bed (18) is carried by cranks (24) on the shaft (22). The cranks (24) have bearings (26) for a generally cylindrical housing (28). Housing (28) is welded to a support plate (30) by means of forward and rear arms (32-32). Upper die bed (18) is carried by support plate (30) on sliders (described below).

As the shaft rotates, the crank (24) orbits around an annular path, the housing (28), riding on bearings (26) orbits with the crank, but the crank rotates within the housing for reasons described below.

Lower die bed (14) is carried on lower slide rails and gibbs (38), which are in turn supported on suitable columns. Thus a set of forming dies can be mounted on the upper and lower die beds, for forming various different shapes sequentially in the sheet metal. These may be simple blanked out openings, but will usually be openings with indentations, and formed sections and flanges.

Figure 3:
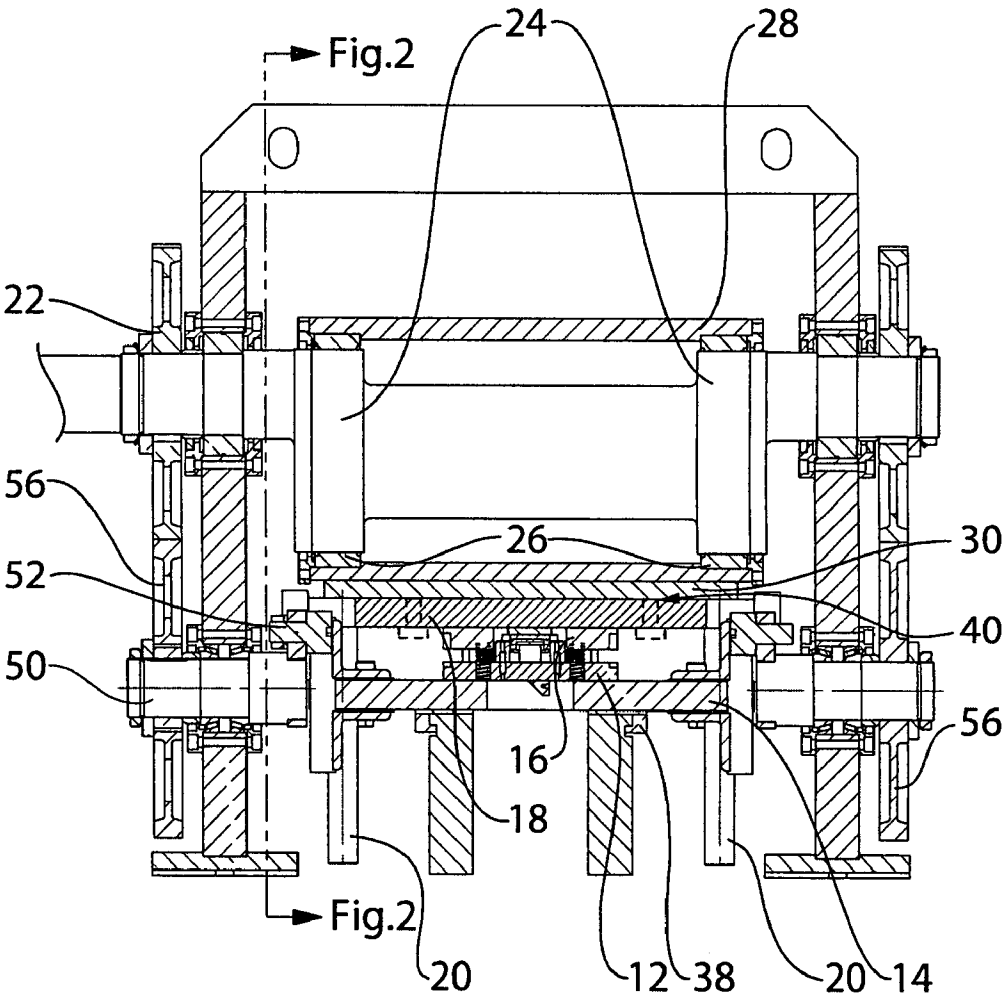
FIG. 3 is a side elevation of the apparatus.

The upper die bed (18) is carried beneath support plate (30) on upper rails or slides and gibbs (40), shown in phantom in FIG. 3, similar to slides and gibbs (38).

As the cranks orbit, they will carry the housing with them, but being located within the housing, the housing (28) will orbit. The housing will thus carry with it the support plate (30) and the upper die bed (18) will move around what is essentially an arcuate path, forwardly and rearwardly.

The upper die bed (18) is coupled to the lower die bed (14) by means of posts (20). However the lower die bed (14) does not move upwardly and downwardly, but moves along a linear path. In this way the upper die bed moves along an arcuate downward path and closes towards the lower die bed and then the upper die bed moves along an arcuate upward path and opens again, thereby releasing the formed sheet metal. Thereafter the upper die bed and lower die bed move rearwardly in unison.

The movement of the lower die bed (14) along its linear path is assisted by a rotary drive (described below) coupled to prime mover (M).

Since the movement of the housing (28) is rotary, around an orbit, it will be appreciated that the linear speed imparted to the die assembly by means of its movement will vary. Similarly the rotary drive for the lower die bed (below) is a such that the linear speed imparted by it will also vary from start to stop and back again. As a result, the linear speed of the die assembly is not constant. The speed depends upon the rotational position of the housing (28).

At the 180° bottom dead centre, the linear speed of the die assembly will correspond to the linear speed of the metal M. At 0° top dead centre the linear speed of the die assembly will be opposite and equal to the speed of the sheet metal. At 90° and 270° the linear speed of the die assembly will be zero, relative to the sheet metal. From 270° to 90° the die assembly moves in reverse, rearwardly.

Between 90° and 180° the linear speed of the die assembly relative to the sheet metal will gradually increase. From 180° to 270° the linear speed of the die assembly will then gradually decrease.

Figure 2:
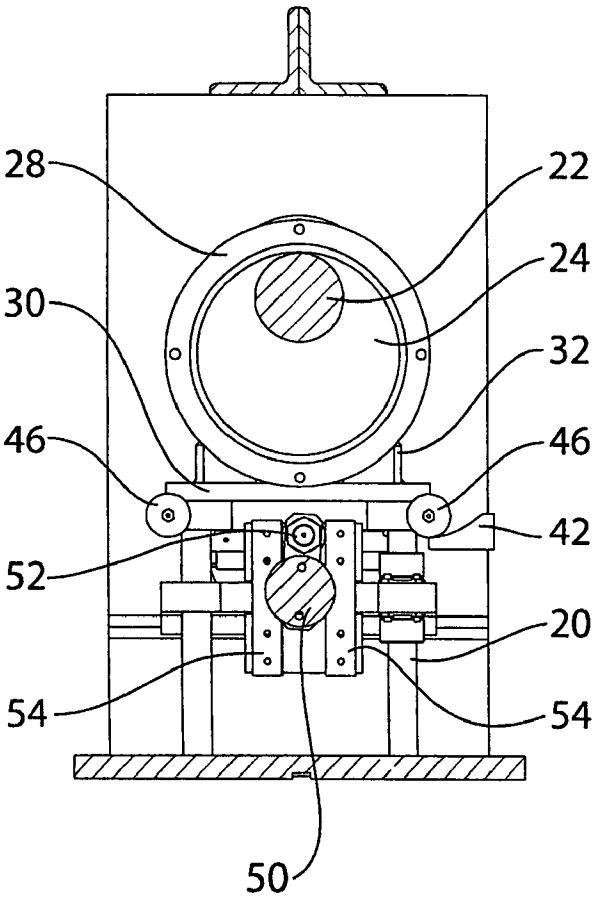
FIG. 2 is an end elevation of the apparatus.
Figure 4:
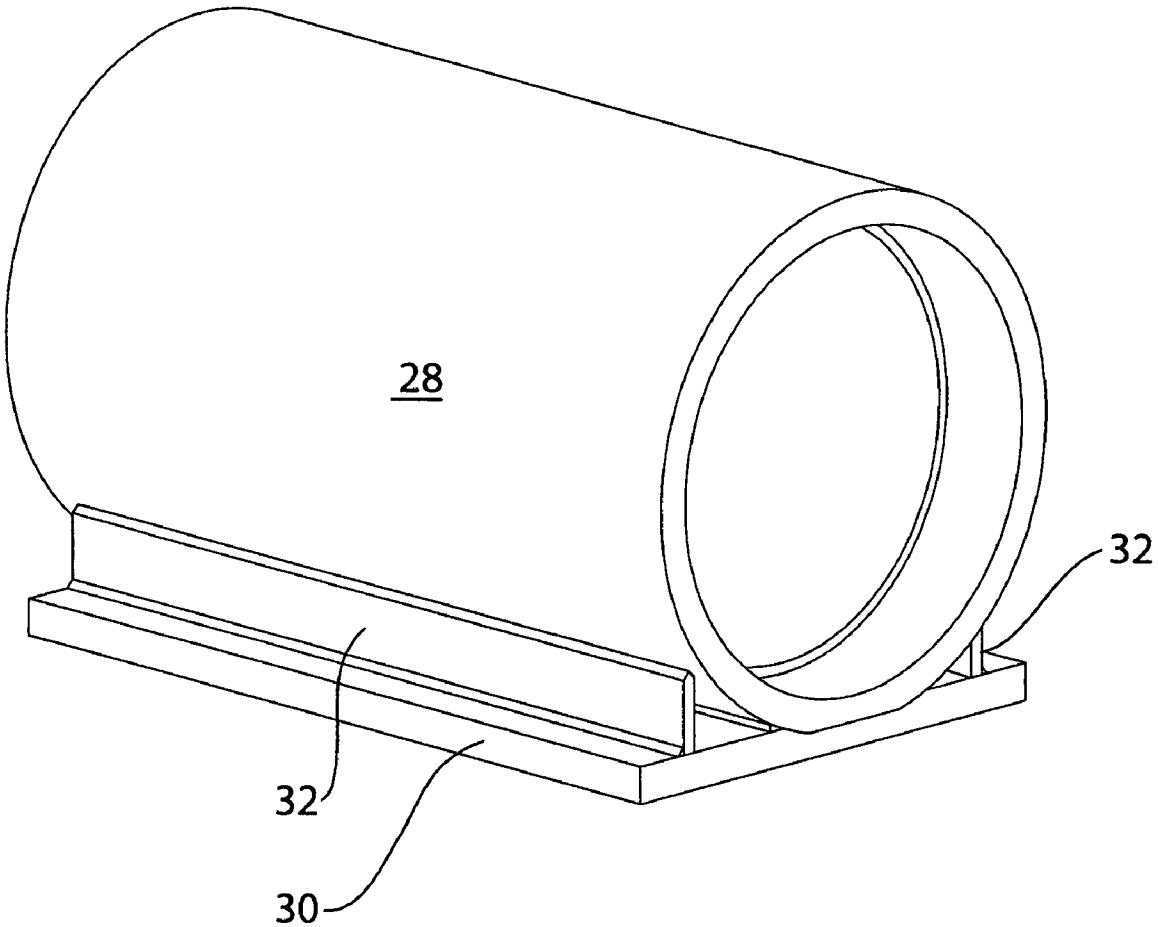
FIG. 4 is a perspective of the rotary housing surrounding the crank shaft, and, FIG. 5 is a schematic side elevation showing movement of the housing in phantom.
Figure 5:
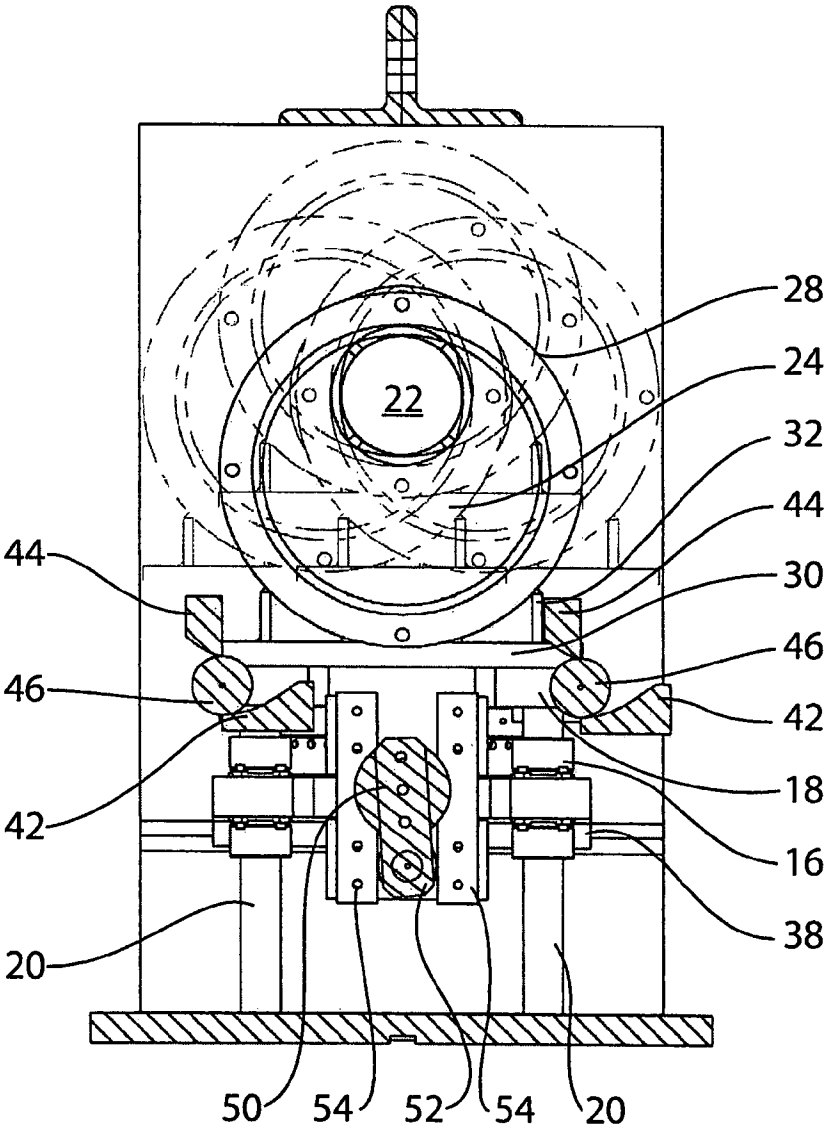

In order to compensate for this change in linear speeds, speed adjustment ramps (42) ad (44) are incorporated (FIGS. 1 and 2 and 5). Lead ramps (42) have generally arcuate profiles to engage ramps followers (46) as the die assembly closes. The trailing ramps (44) are located to engage ramp followers (46) on the upper bed die so as to engage followers (46) as the dies open.

Four ramp followers (46) in the form of rollers are mounted on the upper die bed (18). As the upper die bed (18) is moved downwardly by the housing (28) from three o'clock, closing towards the six o'clock position, the ramp followers will engage the lead ramps (42). The upper die bed (18) will speed up also moving the lower die bed (14) and start moving by sliding on gibbs (38) in the linear direction, faster than the linear speed of the housing (28). As the housing reaches the six o'clock closed position, the followers (46) will leave the ramps (42) and the die beds (18) and (14) and upper and lower dies will be moving at the linear speed of the sheet metal. As the housing rotates further from seven to eight towards nine o'clock the dies open. The ramp followers (46) will engage trailing ramps, (44) and move the die bed (18) and (14) faster than the linear speed of the housing. In this way the linear speed of the dies matches the linear speed of the sheet metal.

As the upper die closes on the lower die approaching 180° the followers (46) disengage from the ramps (42). After passing through 180° (six o'clock) the followers (46) engage the trailing ramps (44) and maintain speed. In this way, while the dies are actually closing on the sheet metal and opening once more, the linear speed of the dies in the die assembly is maintained exactly equal to the linear speed of the sheet metal. This ensures clean forming of the sheet metal and avoids damage to the dies.

It will be understood that the adjusting effect of the ramps takes place only just before closing, and from just after closing to just after separation. The amount of the actual adjustment results in a movement of the die assembly by only a fractional distance. This will largely depend on the gauge of the sheet metal, with a larger gauge requiring somewhat more adjustment, and a thinner gauge requiring less. It will also depend on the depth of the formations being indented into the sheet metal. The deeper the two dies have to interengage, the longer they will be in contact with the sheet metal, therefor the speed must be match over a longer distance in the linear direction of travel.

In order to power and assist the forward movement of the lower die bed (14), the lower die bed (14) is provided with a rotary drive shaft indicated generally as (50). This drive shaft is connected to cams (52). Cams (52) engage bars (54) connected to lower die bed (14). As the drive shaft (50) rotates, the cams (52) orbit through 360°. As they orbit, the cams will drive the lower die bed (14) forward and then backward once more. Drive shaft (50) is driven by gears (56), from prime mover (P).

In order to permit the lower die bed (14) and lower die to move and match the speed of the sheet metal, there is a slight degree of clearance between cams (52) and bars (54). In this way when the upper die bed (18) is moved by ramps (42) and (44) the lower die bed (14) will also move with the upper die bed (18).

In this way, both the upper and the lower dies and die beds are driven and forwardly and then backwardly together in unison. The ramps and followers may also assist in holding support plate (30) and die bed (18) level and parallel to die bed (14) before, during, and after contact with the sheet metal, although this function is achieved primarily by posts (20).

The foregoing is a description of a preferred embodiment of the invention which is given here by way of example only. The invention is not to be taken as limited to any of the specific features as described but comprehends all such variations as come with in the scope of the appended claims.

The invention claimed is:

1. A rotary stamping apparatus for forming moving sheet metal and comprising;

a die assembly moveable forward and backward on opposite sides of the sheet metal, having upper and lower dies on respective sides of the sheet metal, the dies being closeable on the sheet metal for forming thereof;

a rotary drive crank system coupled to the die assembly, and operable to move said die assembly forward and backward along said linear path, and being further operable to close said dies in said die assembly on said sheet metal;

the die assembly being moveable in a linear direction along rails parallel to the sheet metal:

bearings on driving the rotary crank, and a housing being carried on said bearings for rotating relative to said rotary crank;

a speed adjustment mechanism in the form of arcuate drive ramps and followers therefor, on said die assembly connecting with said ramps and being operable for correcting slight mismatching between the line speed of the metal and the linear speed of the die assembly, during closing and opening of said dies.

2. A drive rotary stamping apparatus for forming moving sheet metal as claimed in claim 1 wherein said housing is carried as part of the rotary crank system, being generally cylindrical and a support plate member secured on said housing, and said upper die bed being mounted on said support plate, and said support plate and said upper die bed moving along a generally arcuate path forwardly and rearwardly.

3. An eccentric drive rotary stamping apparatus for forming moving sheet metal as claimed in claim 2 and including, slide rail members and slides on and said support plate, whereby said upper die bed is slidable in a linear direction to and fro along said support plate.

4. A rotary stamping apparatus for forming moving sheet metal as claimed in claim 2 and including;

a lower die bed for supporting said lower die, and slide rails and slides supporting said lower die bed whereby said lower die bed is slidable to and fro.

5. A rotary stamping apparatus for forming moving sheet metal as claimed in claim 4 and including;

a lower drive system coupled to said lower die bed, and being operable to move said lower die bed forwards and backwards along said slide rails and slides.

6. A rotary stamping apparatus for forming moving sheet metal as claimed in claim 5 and including;

leading ramp members, for engaging followers, as said upper die bed is moving downwardly, and trailing ramp members for engaging said followers as said upper die bed is moving upwardly, said leading and trailing ramp members procuring movement of said upper die bed relative to said upper support plate, whereby to match the speed of said die assembly with the speed of movement of said sheet metal.

7. A rotary stamping apparatus for forming moving sheet metal as claimed in claim 6 including slide posts connecting said upper and lower die beds, whereby said upper and lower dies may close and open, with one said die bed sliding along said posts, and wherein said first and second drive systems are coupled to a single prime mover and so as to drive both said upper and lower die beds in the same direction simultaneously, and in registration with one another.

8. A method of forming moving sheet metal, using apparatus having a die assembly moveable forward and backward on opposite sides of the sheet metal, the dies being closeable on the sheet metal for forming thereof, and including the steps of moving said die assembly along said forward and backward path by means of a rotary crank coupled to the die assembly;

closing said dies in said die assembly on said sheet metal by the operation of said rotary crank thereby forming said sheet metal while said sheet metal is moving; and, adjusting the forward speed of the die assembly at a point just before closing of the die assembly and maintaining such speed until a point just after die opening, whereby to match the speed of the die assembly with the sheet metal.

9. A method of forming moving sheet metal, as claimed in claim 8 and including the steps of moving a first die on one side of said sheet metal along a generally arcuate path, and simultaneously moving a second die on the opposite side of said sheet metal along a linear reciprocal path, and simultaneously reciprocating said first die towards and away from said second die, for forming and releasing said sheet metal.

10. A method of forming moving sheet metal, as claimed in claim 9 and including the steps of driving said first die, by a first rotary drive system and including driving said second die, by a second rotary drive system coupled to said first drive system and wherein said first rotary drive system drives said first die around said generally arcuate path, and wherein said second rotary drive system drives said second die along said linear path, thereby moving said first and second dies in unison along two different paths.

11. A method of forming moving sheet metal, as claimed in claim 10 and including the steps of adjusting the linear speed of said first and second die beds at a point just before closing on said sheet metal, and from closing to a point just after opening, whereby to match the linear speed of the sheet metal, during closing and opening of said dies.

* * * * *